US009425511B1

(12) United States Patent
Krishmar-Junker et al.

(10) Patent No.: US 9,425,511 B1
(45) Date of Patent: Aug. 23, 2016

(54) EXCITATION METHOD OF COAXIAL HORN FOR WIDE BANDWIDTH AND CIRCULAR POLARIZATION

(71) Applicant: NORTHROP GRUMMAN SYSTEMS CORPORATION, Falls Church, VA (US)

(72) Inventors: Gregory P. Krishmar-Junker, Gardena, CA (US); Philip W. Hon, Hawthorne, CA (US); Arun K. Bhattacharyya, Littleton, CO (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 50 days.

(21) Appl. No.: 14/660,693

(22) Filed: Mar. 17, 2015

(51) Int. Cl.

| | |
|---|---|
| ***H01Q 13/00*** | (2006.01) |
| ***H01Q 13/24*** | (2006.01) |
| ***H01Q 13/02*** | (2006.01) |
| ***H01Q 1/48*** | (2006.01) |
| ***H01Q 1/50*** | (2006.01) |

(52) U.S. Cl.
CPC ..... *H01Q 13/02* (2013.01); *H01Q 1/48* (2013.01); *H01Q 1/50* (2013.01)

(58) Field of Classification Search
CPC ..... H01Q 13/00; H01Q 13/24
USPC ..... 343/786
See application file for complete search history.

(56) References Cited

U.S. PATENT DOCUMENTS 4,041,499 A 8/1977 Liu et al.
4,274,097 A * 6/1981 Krall ..... H01Q 13/24 343/719
5,041,840 A 8/1991 Cipolla et al.
5,109,232 A 4/1992 Monte
6,137,450 A 10/2000 Bhattacharyya et al.
6,271,799 B1 8/2001 Rief et al.
6,535,174 B2 3/2003 Rao et al.
6,577,283 B2 * 6/2003 Wu ..... H01Q 5/40 343/786
7,511,678 B2 * 3/2009 Wu ..... H01Q 5/47 343/786
7,834,808 B2 11/2010 Thompson et al.

(Continued)

OTHER PUBLICATIONS

Sethi, Waleed Tariq et al. "High Gain and Wide-Band Aperture-Coupled Microstrip Patch Antenna with Mounted Horn Integrated on FR4 for 60 GHz Communication Systems" IEEE Symposium on Wireless Technology and Applications (ISWTA), Sep. 22-25, 2013, Kuching, Malaysia, IEEE 2013, pp. 359-362.

(Continued)

*Primary Examiner* — Hoang V Nguyen
(74) *Attorney, Agent, or Firm* — John A. Miller; Miller IP Group, PLC

(57) ABSTRACT

A coaxial feed horn including a dielectric substrate having at least one microstrip feed line deposited on a bottom surface of the substrate and a ground plane deposited on a top surface of the substrate. A cylindrical outer conductor is electrically coupled to the ground plane and an embedded conductor is coaxially positioned within the outer conductor, where the embedded conductor is in electrical contact with the microstrip line. A dielectric member is positioned within the outer conductor and includes a tapered portion extending out of the outer conductor at the aperture. In one embodiment, the dielectric member is a plurality of dielectric layers each having a different dielectric constant, where a first dielectric layer allows for propagation of a $TE_{11}$ sum mode and a last dielectric layer is positioned proximate the antenna aperture and allows for propagation of a $TE_{12}$ difference mode.

20 Claims, 3 Drawing Sheets

(56) References Cited

U.S. PATENT DOCUMENTS

| | | | |
|---|---|---|---|
| 8,164,533 | B1 | 4/2012 | Hsu et al. |
| 8,248,321 | B2 | 8/2012 | Anderson et al. |
| 8,514,140 | B1 | 8/2013 | Rao et al. |
| 8,519,891 | B2 | 8/2013 | Chen |
| 9,325,074 | B2 | 4/2016 | Chandler |
| 2004/0036661 | A1 | 2/2004 | Hanlin et al. |

OTHER PUBLICATIONS

Mehrdadian, Ali et al. "Design of a Combined Antenna for Ultra Wide-Band High-Power Applications" 6'th International Symposium on Telecommunications (IST'2012), IEEE 2012, pp. 106-110.
Mallahzadeh, A. R. et al. "A Novel Dual-Polarized Double-Ridged Horn Antenna for Wideband Applications" Progress in Electromagnetics Research B, vol. 1, pp. 67-80, 2008.
Granet, C. et al. "The Designing, Manufacturing, and Testing of a Dual-Band Feed System for the Parkes Radio Telescope" IEEE Antennas & Propagation Magazine, vol. 47, No. 3, pp. 13-19, 2005.
Nasimuddin et al. "Compact Circularly Polarized Enhanced Gain Microstrip Antenna on High Permittivity Substrate" APMC2005 Proceedings, IEEE 2005, 4 pgs.
Jung, Young-Bae et al. "Novel Ka-band Microstrip Antenna Fed Circular Polarized Horn Array Antenna" IEEE 2004. pp. 2476-2479.
Sironen, Mikko et al. "A 60 GHz Conical Horn Antenna Excited with Quasi-Yagi Antenna" IEEE MTT-S Digest, 2001, pp. 547-550.
Lopez, Alonso A. et al. "Design of Multimode Coaxial Feeders for Cassegrain Antennas" Microwave Conference, European, Sep. 6-10, 1993, pp. 899-902.
Bird, Trevor S. et al. "Input Mismatch of TE11 Mode Coaxial Waveguide Feeds" Transactions on Antennas and Propagation, vol. AP-34, No. 8, Aug. 1996, pp. 1030-1033.

* cited by examiner

EXCITATION METHOD OF COAXIAL HORN FOR WIDE BANDWIDTH AND CIRCULAR POLARIZATION

BACKGROUND

1. Field

This invention relates generally to a wide bandwidth, narrow beam coaxial antenna feed horn and, more particularly, to a wide bandwidth, coaxial antenna feed horn that includes a tapered dielectric at the horn aperture for impedance matching to free space and/or a multi-layered dielectric member that allows propagation of a $TE_{11}$ sum mode and a $TE_{12}$ difference mode starting at the same cut-off frequency, where polarization may be linear or circular.

2. Discussion

For certain communications applications, it is desirable to have a broadband system, namely, operation over a relatively wide frequency range, typically greater than 1.5:1. In some reflector based systems, it is desirable to have a feed with a small foot print, making it suitable for illuminating very low focal length to diameter ratios reflector lens.

In certain communications systems, signal tracking between the receiver and transmitter is achieved with the use of a sum and difference pattern. A sum pattern presents a broadside peak radiation pattern, while a difference pattern provides a broadside null radiation pattern. In this case, two electromagnetic propagation modes, the transverse-electric (TE) modes ($TE_{11}$, $TE_{12}$) in the feed horn are needed to realize a sum and difference within the same frequency range. In general, the $TM_{00}$ mode is used for linear polarization. System performance requirements may call for a large instantaneous RF bandwidth and a small physical footprint, to name a few.

A critical element to achieve the signal tracking feature, while meeting system specifications is the feed antenna. To meet size constraints, a smaller aperture size is usually desired, such as that of a coaxial horn antenna. However, its cut-off frequency of the $TE_{12}$ difference mode is twice the cut-off frequency of the $TE_{11}$ sum mode, where the cut-off frequency of a particular mode is the lowest frequency that the mode can propagate. It is known in the art to load such a feed horn with a dielectric to lower the cut-off frequency of a particular mode. In addition to realizing the necessary modes for generating the sum and difference mode, ample signal from the feed horn must be transmitted/received. Namely, for a small aperture relative to the operating wavelength feed horn, there exists a significant impedance mismatch between the dielectric and free space resulting in significant signal loss.

DETAILED DESCRIPTION OF THE EMBODIMENTS

The following discussion of the embodiments of the invention directed to a broadband coaxial antenna feed horn is merely exemplary in nature, and is in no way intended to limit the invention or its applications or uses.

Figure 1:
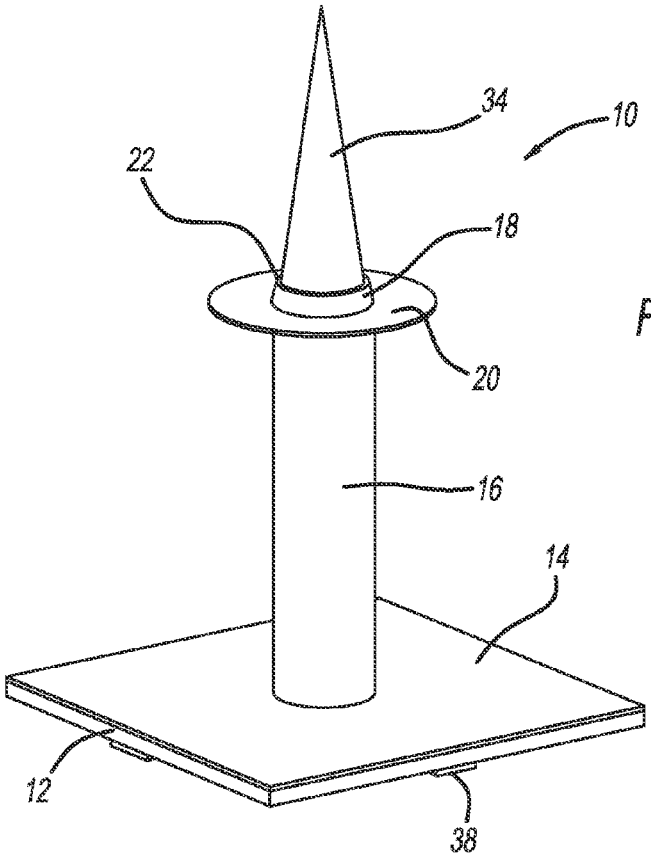
FIG. 1 is an isometric view of a coaxial antenna feed horn.
Figure 2:
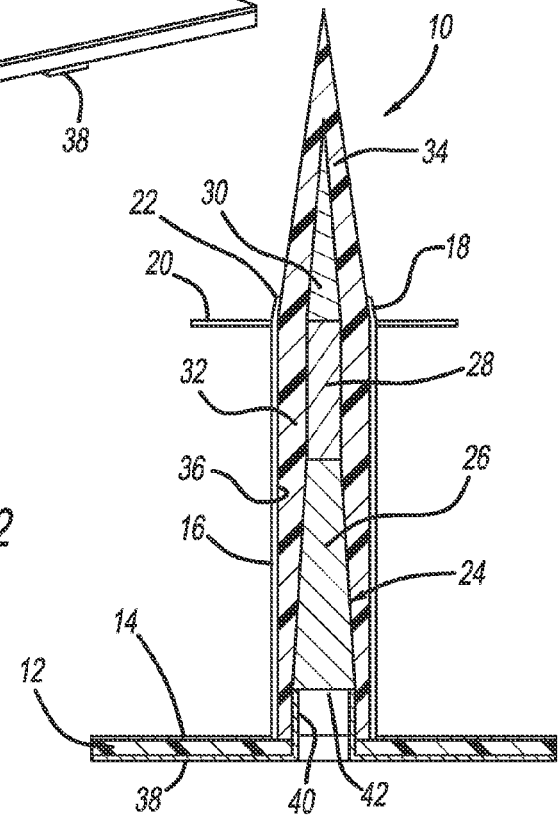
FIG. 2 is a cross-sectional view of the feed horn shown in FIG. 1.
Figure 3:
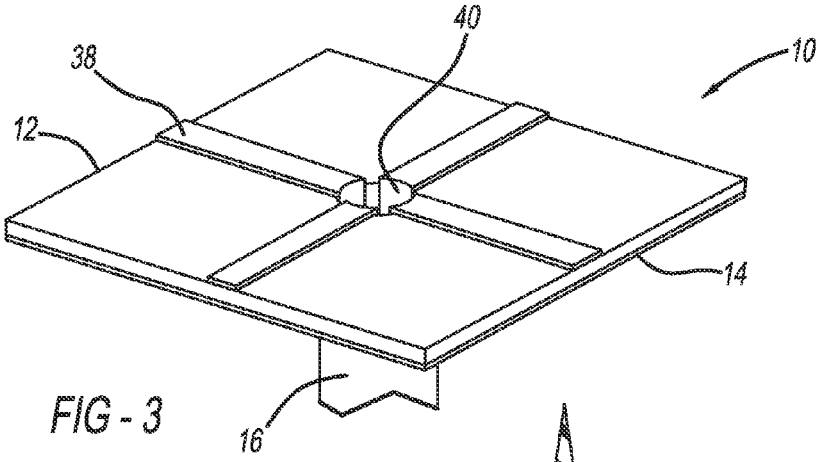
FIG. 3 is a cut-away, bottom isometric view of the feed horn shown in FIG. 1.

FIG. 1 is an isometric view, FIG. 2 is a cross-sectional view and FIG. 3 is a cut-away, bottom isometric view of a coaxial antenna feed horn 10 having appropriate dimensions for a particular wide bandwidth frequency band, for example, 21-51 GHz. The horn 10 includes a dielectric substrate 12, such as Rogers Duroid, having, for example, a relative dielectric constant $\in_r=3$. A conductive finite ground plane 14, such as copper, is deposited on a top surface of the substrate 12 and is in electrical contact with an outer cylindrical ground conductor 16, such as copper, defining a cylindrical chamber 36 therein. The conductor 16 includes a tapered portion 18 defining an aperture 22 of the horn 10 opposite to the substrate 12, as shown. A circular ground plane 20 is in electrical contact with the outer conductor 16 proximate the aperture 22, as shown. The ground plane 20 can be any applicable size and/or shape for a particular embodiment, and can be electrically coupled to the conductor 16 at any location along its length. Further, it is noted that the ground plane 20 can be eliminated in some embodiments.

An embedded conductor 24 is provided within the chamber 36 and is coaxial with the ground conductor 16, where the embedded conductor 24 includes a lower conical section 26, a middle cylindrical section 28 and a tapered section 30 extending through the aperture 22. A dielectric member 32 is provided within the chamber 36 between the embedded conductor 24 and the outer conductor 16 and includes a tapered end section 34 surrounding the tapered section 30 and extending from the aperture 22. A series of four microstrip feed lines 38 positioned at 90° relative to each other are deposited on a bottom surface of the substrate 12 opposite to the ground plane 14. In this non-limiting embodiment, four independent microstrip lines 40 attached to the feed lines 38 and extends through the substrate 12 to be electrically attached to a cylindrical feed line transition member 42 that is electrically attached to a lower end of the conical section 26 of the embedded conductor 24. The conical section 26 provides a microstrip-to-coaxial mode transformer that allows a signal on the microstrip feed lines 38 propagating in the microstrip mode to be converted to a coaxial transmission mode. The conductive material discussed herein can be any suitable conductor, such as copper, where the embedded conductor 24 can be a solid piece or be hollow.

The tapered section 34 of the dielectric member 32 provides a transition for impedance matching between the aperture 22 of the feed horn 10 and free space. It is typically desirable to provide a transition of the tapered section 34, which makes it longer, to provide the best impedance matching to free space. In one non-limiting embodiment for the frequency band mentioned above, the dielectric member 32 can be Teflon having a dielectric constant of $\in_r=2.1$, and the tapered section 34 has a length of about 0.63 in. The conical section 26 provides impedance matching between the microstrip lines 38 and 40 and the embedded conductors 28, 36. Further, excitation signals applied to the microstrip lines 38 are phased to excite the $TE_{11}$ sum mode in the horn 10, which generates a circularly polarized sum pattern.

The dielectric member 32 extends the length of the horn 10 and is homogeneous, i.e., has the same dielectric constant from top to bottom. In this design, the $TE_{12}$ difference mode cut-off frequency is still above the $TE_{11}$ sum mode cut-off frequency. In order to reduce the cut-off frequency of the $TE_{12}$ difference mode to be the same as that of the $TE_{11}$ sum mode so that they propagate within the desired frequency range for signal tracking, the present invention proposes providing a $TE_{12}$ difference mode excitation signal to the antenna feed horn 10 and provide a transition in the dielectric constant of the dielectric 32 to reduce the cut-off frequency of the $TE_{12}$ difference mode. By loading the feed horn with a relatively higher dielectric material, the cut-off frequency for the $TE_{12}$ difference mode can be lowered to the cut-off frequency of the $TE_{11}$ sum mode, thus allowing both modes to propagate at the same time and at the same frequency, although in axially different locations.

Figure 4:
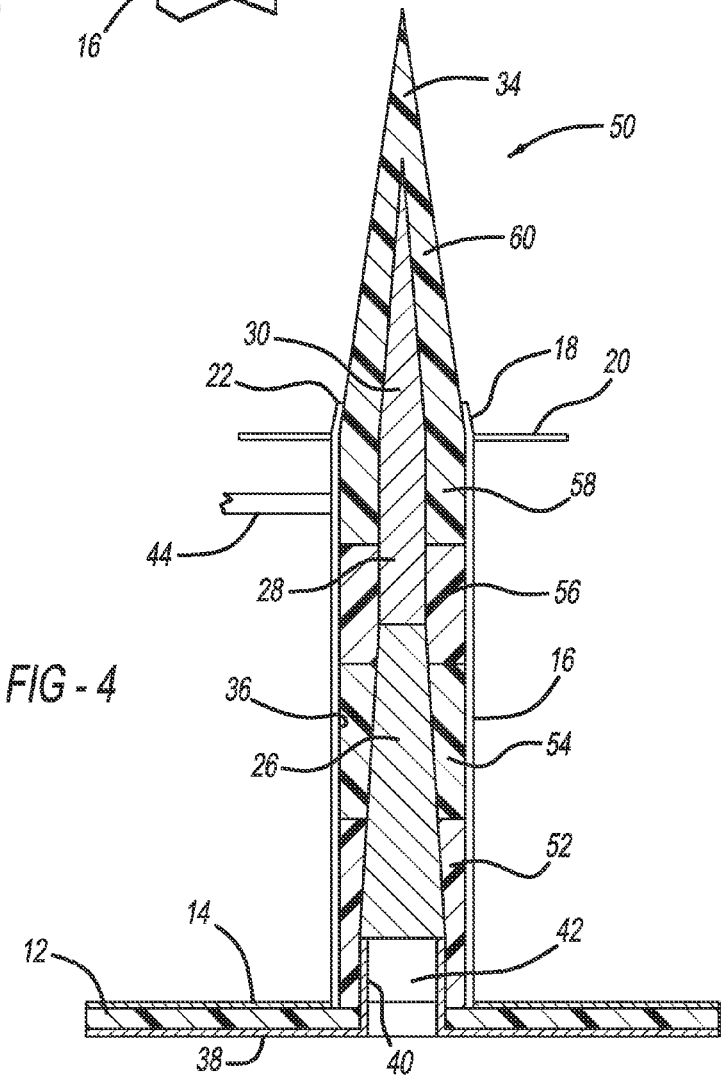
FIG. 4 is a cross-sectional view of a coaxial antenna feed horn including multiple dielectric layers.

FIG. 4 is a cross-sectional view of a coaxial antenna feed horn 50 showing this embodiment that is similar to the feed horn 10, where like elements are identified by the same reference number. In this design, the dielectric member 32 is replaced with a plurality of dielectric layers with different dielectric constants $\in_r$ from the bottom of the feed horn 50 to the top of the feed horn 50 to provide impedance matching. For example, a dielectric layer 52 is provided at the bottom of the feed horn 50 within the conductor 16 and has a dielectric constant $\in_r$ that allows propagation of the $TE_{11}$ sum mode, such as Teflon having a constant $\in_r$=2.1, where the $TE_{11}$ sum mode is generated by the excitation signal applied to the microstrip lines 38. A plurality of other dielectric layers are provided on top of the dielectric layer 52 in ascending order of dielectric constant $\in_r$ to provide impedance matching between the layers in this non-limiting embodiment. In this particular design, a dielectric layer 54 is provided on top of the dielectric layer 52 and has a larger dielectric constant $\in_r$ than the dielectric layer 52, a dielectric layer 56 is provided on top of the dielectric layer 54 and has a larger dielectric constant $\in_r$ than the dielectric layer 54, and a dielectric layer 58 is provided on top of the dielectric layer 56 and includes a tapered section 60 extending out of the aperture 18, where the dielectric layer 58 has a larger dielectric constant $\in_r$ than the dielectric layer 56. The dielectric layer 58 also has the proper dielectric constant $\in_r$ that allows propagation of the $TE_{12}$ difference mode, such as $\in_r$=6. It is noted, that the $TE_{11}$ sum mode propagates in and above the lines 40, and the orthogonal $TE_{12}$ difference mode propagates in and above the layer 58.

In one non-limiting embodiment shown merely for illustrative purposes, the dielectric layer 54 is fused silica having a dielectric constant $\in_r$=3, the dielectric layer 56 is boron nitride having a dielectric constant $\in_r$=4 and the dielectric layer 58 is beryllium oxide having a dielectric constant $\in_r$=6. Further, also by way of a non-limiting example, the dielectric layer 52 can be 0.13", the dielectric layer 54 can be 0.248", the dielectric layer 56 can be 0.193" and the cylindrical portion of the dielectric layer 58 below the aperture 18 can be 0.176".

For this embodiment, an excitation signal needs to be applied to the horn 50 to generate the $TE_{12}$ difference mode and needs to be applied in the area of the dielectric layer 58, which has the dielectric constant $\in_r$ that allows the $TE_{12}$ difference mode to propagate in the horn 50 at the lower cut-off frequency. This signal can be applied in any suitable manner to the horn 50. As a general representation of this, an electrical probe 44 is shown proximate the dielectric layer 58 to which the $TE_{12}$ difference mode excitation signal is provided.

Figure 5:
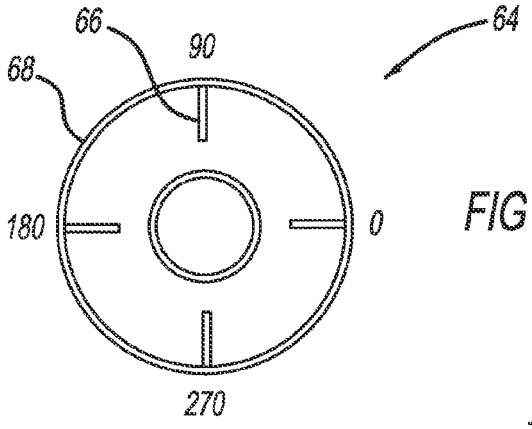
FIG. 5 is an illustration showing circularly polarized excitation for a $TE_{11}$ sum mode.

In order to obtain the $TE_{11}$ sum propagation mode, a uniform amplitude phase changing excitation signal is applied to the microstrip lines 38. For example, FIG. 5 is an illustration 64 showing electrical terminals 66 at positions 0°, 90°, 180° and 270° around an outer conductor 68 representing the lines 40 to which the $TE_{11}$ sum propagation mode excitation signal is selectively applied in rotation.

Figure 6:
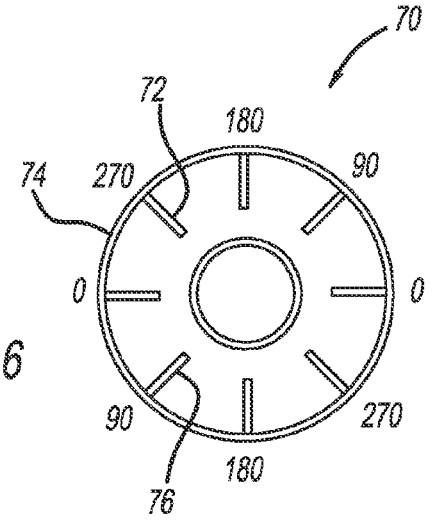
FIG. 6 is an illustration showing circularly polarized excitation for a $TE_{12}$ difference mode.

In order to obtain the $TE_{11}$ sum propagation mode and the $TE_{12}$ difference propagation mode, a uniform amplitude phase changing excitation signal is applied to the microstrip lines 38 and 44. For example, FIG. 6 is an illustration 70 showing electrical terminals 72 at positions 0°, 90°, 180° and 270° around an outer conductor 74 representing the microstrip lines 40. In order to obtain the $TE_{12}$ difference propagation mode, a constant amplitude phase changing excitation signal is provided to 70 at each of the electrical terminals 72. The relative phase difference at each electrical terminal 72, in a counter clockwise fashion are 0°, 90°, 180°, 270°, 0°, 90°, 180°, 270.

Figure 7:
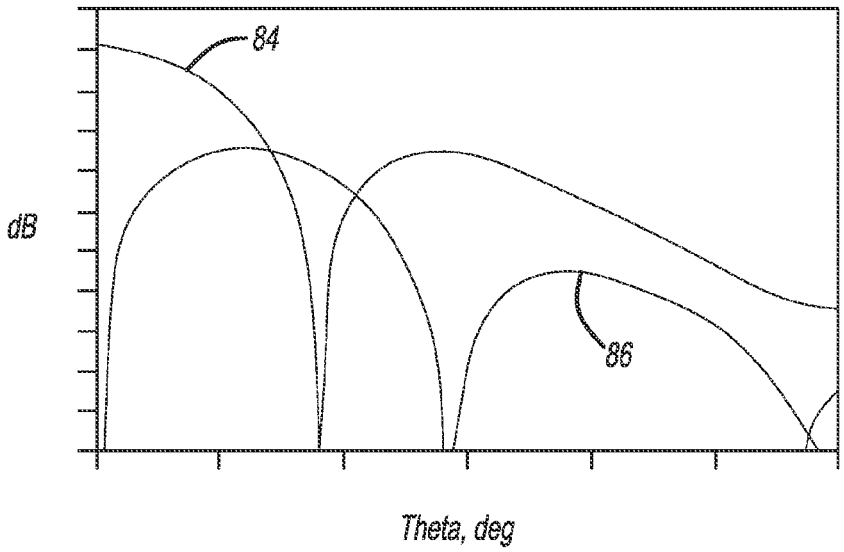
FIG. 7 is a representative directivity plot with elevation angles (degrees) represented on the horizontal axis and directivity (dB) on the vertical axis showing a $TE_{11}$ sum mode circular polarization pattern and a $TE_{12}$ difference mode circular polarization pattern.

FIG. 7 is a representative directivity plot with elevation angles (degrees) represented on the horizontal axis and directivity (dB) on the vertical axis showing a $TE_{11}$ sum mode circular polarization. Particularly, plot line 84 is the $TE_{11}$ sum antenna pattern and plot line 86 is the $TE_{12}$ difference antenna pattern.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A coaxial feed horn comprising:

a dielectric substrate including a top surface and a bottom surface;

at least one microstrip feed line deposited on the bottom surface of the substrate;

a first ground plane deposited on the top surface of the substrate;

a cylindrical outer conductor electrically coupled to the ground plane and including an internal chamber, said outer conductor including an opening opposite to the substrate defining an aperture of the feed horn;

an embedded conductor positioned within the chamber and being coaxial with the outer conductor, said embedded conductor including a conical section in electrical contact with the at least one microstrip line, a cylindrical section opposite the substrate and a tapered section extending out of the outer conductor at the aperture; and a dielectric member positioned within the chamber and being external to the embedded conductor, said dielectric member including a tapered portion extending out of the outer conductor at the aperture.

2. The feed horn according to claim 1 wherein the tapered portion has a taper selected to provide impedance matching between free space and propagating modes of interest.

3. The feed horn according to claim 1 wherein the at least one microstrip feed line is four feed lines oriented 90° apart.

4. The feed horn according to claim 1 wherein a dielectric constant of the dielectric member is selected to allow propagation of a $TE_{11}$ sum mode.

5. The feed horn according to claim 1 wherein a signal propagating on the at least one microstrip line is circularly polarized, and wherein the conical section has a taper selected to provide impedance matching of the signal from a microstrip mode to a coaxial mode.

6. The feed horn according to claim 1 wherein the dielectric member includes a plurality of dielectric layers having defined dielectric constants where a first dielectric layer is positioned at a lower end of the outer conductor and has the lowest dielectric constant and a last dielectric layer includes the tapered portion and has the highest dielectric constant, said plurality of dielectric layers lower a cut-off frequency of a desired frequency band.

7. The feed horn according to claim 6 wherein the first dielectric layer has a dielectric constant selected to allow propagation of a sum $TE_{11}$ mode and the last dielectric layer has a dielectric constant selected to allow propagation of a difference $TE_{12}$ mode.

8. The feed horn according to claim 7 wherein the first dielectric layer has a dielectric constant of about 2.1 and the last dielectric layer has a dielectric constant of about 6.

9. The feed horn according to claim 6 wherein the plurality of dielectric layers is four dielectric layers.

10. The feed horn according to claim 1 further comprising a second ground plane electrically coupled to the outer conductor proximate the aperture.

11. The feed horn according to claim 1 wherein the feed horn is part of a satellite communications system.

12. A coaxial feed horn comprising:

a dielectric substrate including a top surface and a bottom surface;

at least one microstrip feed line deposited on the bottom surface of the substrate;

a ground plane deposited on the top surface of the substrate;

a cylindrical outer conductor electrically coupled to the ground plane and including an internal chamber, said outer conductor including an opening opposite to the substrate defining an aperture of the feed horn;

an embedded conductor positioned within the chamber and being coaxial with the outer conductor; and a plurality of dielectric layers positioned within the chamber and being external to the embedded conductor, said plurality of dielectric layers having defined dielectric constants where a first dielectric layer is positioned at a lower end of the outer conductor and has a lowest dielectric constant and a last dielectric layer is positioned proximate the aperture and has a highest dielectric constant to provide impedance matching and to allow propagation of a $TE_{12}$ difference mode.

13. The feed horn according to claim 12 wherein the first dielectric layer has a dielectric constant selected to allow propagation of a $TE_{11}$ sum mode and the last dielectric layer has a dielectric constant selected to allow propagation of the $TE_{12}$ difference mode.

14. The feed horn according to claim 13 wherein the first dielectric layer has a dielectric constant of about 2.1 and the last dielectric layer has a dielectric constant of about 6.

15. The feed horn according to claim 12 wherein the plurality of dielectric layers is four dielectric layers.

16. The feed horn according to claim 12 wherein the last dielectric layer includes a tapered portion extending out of the outer conductor at the aperture, said tapered portion having a taper selected to provide impedance matching between a signal propagating on the embedded conductor and free space.

17. The feed horn according to claim 12 wherein the at least one microstrip feed line is four feed lines oriented 90° apart.

18. A coaxial feed horn comprising:

a dielectric substrate including a top surface and a bottom surface;

four microstrip feed lines deposited on the bottom surface of the substrate and being spaced 90° apart;

a ground plane deposited on the top surface of the substrate;

a cylindrical outer conductor electrically coupled to the ground plane and including an internal chamber, said outer conductor including an opening opposite to the substrate defining an aperture of the feed horn;

an embedded conductor positioned within the chamber and being coaxial with the outer conductor, said embedded conductor including a conical section in electrical contact with the at least one microstrip line, a cylindrical section opposite the substrate and a tapered section extending out of the outer conductor at the aperture; and a plurality of dielectric layers positioned within the chamber and being external to the embedded conductor, said plurality of dielectric layers having defined dielectric constants where a first dielectric layer is positioned at a lower end of the outer conductor and has a lowest dielectric constant and a last dielectric layer is positioned proximate the aperture and has a highest dielectric constant, wherein the first dielectric layer has a dielectric constant selected to allow propagation of a $TE_{11}$ sum mode and the last dielectric layer has a dielectric constant selected to allow propagation of a $TE_{12}$ difference mode.

19. The feed horn according to claim 18 wherein a signal propagating on microstrip feed lines is circularly polarized, and wherein the conical section has a taper selected to provide impedance matching of the signal from a microstrip mode to a coaxial mode.

20. The feed horn according to claim 18 wherein the first dielectric layer has a dielectric constant of about 2.1 and the last dielectric layer has a dielectric constant of about 6.

* * * * *